US006633208B2

(12) United States Patent
Salkola et al.

(10) Patent No.: US 6,633,208 B2
(45) Date of Patent: Oct. 14, 2003

(54) FILTER WITH IMPROVED INTERMODULATION DISTORTION CHARACTERISTICS AND METHODS OF MAKING THE IMPROVED FILTER

(75) Inventors: Markku I. Salkola, Goleta, CA (US); Robert B. Hammond, Santa Barbara, CA (US); Neal Fenzi, Santa Barbara, CA (US)

(73) Assignee: Superconductor Technologies, Inc., Santa Barbara, CA (US)

( * ) Notice: Subject to any disclaimer, the term of this patent is extended or adjusted under 35 U.S.C. 154(b) by 0 days.

(21) Appl. No.: 09/886,768

(22) Filed: Jun. 19, 2001

(65) Prior Publication Data

US 2002/0198110 A1 Dec. 26, 2002

(51) Int. Cl.[7] ..... H01P 7/01; H01B 12/02

(52) U.S. Cl. ..... 333/167; 333/99.005; 333/185; 505/700; 505/866

(58) Field of Search ..... 333/167, 172, 333/173, 175, 185, 202, 210, 995; 505/700, 866

(56) References Cited

U.S. PATENT DOCUMENTS

| | | | | | |
|---|---|---|---|---|---|
| 4,981,838 | A | | 1/1991 | Whitehead | |
| 5,760,667 | A | * | 6/1998 | Young et al. | 333/212 |
| 5,888,942 | A | | 3/1999 | Matthaei | |
| 5,914,296 | A | * | 6/1999 | Shen | 505/210 |
| 6,026,311 | A | * | 2/2000 | Willemsen Cortes et al. | 505/210 |
| 6,041,245 | A | | 3/2000 | Mansour | 505/210 |
| 6,075,427 | A | * | 6/2000 | Tai et al. | 333/219 |
| 6,222,429 | B1 | * | 4/2001 | Satoh et al. | 333/202 |
| 6,424,846 | B1 | * | 7/2002 | Cortes et al. | 505/210 |
| 2001/0025013 | A1 | | 9/2001 | Abdelmonem | 505/210 |
| 2001/0038320 | A1 | | 11/2001 | Abdelmonem | 333/99 |

OTHER PUBLICATIONS

David M. Pozar, Microwave Engineering, 1990, pp. 608, 609.*

Chaloupka, H. et al, "Superconducting Planar Disk Resonators and Filters with High Power Handling Capability", Electronic Letters, Aug. 29, 1996, vol. 32, No. 18, pp. 1735–1737.

Dahm, T. et al., "Analysis and Optimization of Intermodulation in High–Tc Superconducting Microwave Filter Design", IEEE Transactions on Applied Superconductivity, vol. 8, No. 4, Dec., 1998, pp. 149–157.

Liang, G. et al, "High–Power HTS Microstrip Filters for Wireless Communication", IEEE Transactions on Microwave Theory and Techniques, vol. 43, No. 12, Dec., 1995, pp. 3020–3029.

Maas, S.A., "Volterra–Series and Power–Series Analysis", Nonlinear Microwave circuits (IEEE Press, Piscataway, JN, 1997), pp. 155–173.

International Search Report in corresponding PCT/US02/16776.

* cited by examiner

*Primary Examiner*—Michael Tokar
*Assistant Examiner*—Vibol Tan
(74) *Attorney, Agent, or Firm*—O'Melveny & Myers LLP

(57) ABSTRACT

Multi-stage electric filters with improved intermodulation-distortion characteristics and a method for designing such electric filters is provided. In general, the invention may include a multi-resonator electric filter in which one or more of the resonators have been intentionally designed to have a different IP and/or Q than the other resonators in the electric filter. In one case, the electric filters include a 4-resonator Chebyshev narrow pass-band filter with at least the first resonator having a Q and/or IP different from at least one other resonator in the filter. The filter thereby has improved IMD power over conventional designed filters while maintaining high Q. In a preferred embodiment the filter may include a superconducting material. The relative Q and IP of the respective resonators in the improved filter may depend on the relative strength of in-band and out-of-band signals. The performance and cost of the electric filter may be optimized by designing the filter to have a relative Q and IP required by the particular application.

130 Claims, 12 Drawing Sheets

Modular Band-Pass Filter Assembly

| | Out-of-Band Signals | In-Band Signals | 1st Res. Q | 1st Res. IP | Middle Res. Q | Middle Res. IP | Last Res. Q | Last Res. IP |
|---|---|---|---|---|---|---|---|---|
| | | | | | | | | |
| 805 | strong | strong - moderately strong | low | high | high | high | low | low |
| 810 | strong | weak | low | high | high | low | low | low |
| 815 | moderately strong | moderately strong | low | low | high | high | low | low |
| 820 | weak - moderately strong | weak | low | low | high | low | low | low |
| | | | | | | | | |

Figure 8

FILTER WITH IMPROVED INTERMODULATION DISTORTION CHARACTERISTICS AND METHODS OF MAKING THE IMPROVED FILTER

TECHNICAL FIELD

The present invention is directed to electric filters, and more particularly to multi-resonator electric filters.

BACKGROUND OF THE INVENTION

Electrical filters are generally known and often include electrical components, such as inductors, capacitors, and resistors. Filters are often used to select desired electric signal frequencies that will be passed through the filter while blocking or attenuating other undesirable electric signal frequencies. Filters may be classified in some general categories that include low-pass filters, high-pass filters, band-pass filters, and band-stop filters, indicative of the type of frequencies which are selectively passed by the filter. Further, filters can be classified by type, such as Butterworth, Chebyshev, Inverse Chebyshev, and Elliptic, indicative of the type of bandshape response (frequency cutoff characteristics) the filter provides relative to the ideal.

Further, the filters often include capacitors and inductors in series or parallel and may include multiple stages or poles that may be resonators. For example, a capacitor and inductor set may make up a resonator, and a four-pole filter may include four resonators each having a capacitor (C) and inductor (L) set. For example, a circuit schematic for an eight-pole band-pass filter is provided in FIG. 1. In this case, each L and C pair are resonators and each of the resonators are capacitively coupled to one another in series. The first resonator 101 includes two capacitors, C1 and C2, and an inductor L1. There are eight such resonators 101–108 making up the eight-pole band-pass filter.

Filters are often used in communication systems. For example, one particular application is for cellular communications and includes the formation of filters useful in the microwave range, such as frequencies above 500 MHz, for base-station transceivers.

Considering the case of conventional microwave filters, there have been basically four types. First, lumped-element filters have used separately fabricated air wound inductors and parallel-plate capacitors, wired together into a filter circuit. These conventional components are relatively small compared to the wave length, and accordingly, make for a fairly compact filter. However, the use of separate elements has proved to be difficult in manufacture, and resulting in large circuit to circuit differences. The second conventional filter structure utilizes mechanical distributed element components. Coupled bars or rods are used to form transmission line networks that are arranged as a filter circuit. Ordinarily, the length of the bars or rods is ¼ or ½ of the wave length at the center frequency of the filter. Accordingly, the bars or rods can become quite sizeable, often being several inches long, resulting in filters over a foot in length. Third, printed distributed element filters have been used. Generally they comprise a single layer of metal traces printed on an insulating substrate, with a ground plane on the back of the substrate. The traces are arranged as transmission line networks to make a filter. Again, the size of these filters can become quite large. The structures also suffer from various responses at multiples of the center frequency. Fourth, cavity filters have been used. They also suffer from various responses at multiples of the center frequency and can be quite large.

Various thin-film lumped-element structures have been proposed. Swanson U.S. Pat. No. 4,881,050, issued Nov. 14, 1989, discloses a thin-film microwave filter utilizing lumped elements. In particular, a capacitor π network utilizing spiral inductors and capacitors is disclosed. Generally, a multi-layer structure is utilized, a dielectric substrate having a ground plane on one side of the substrate and multiple thin-film metal layers and insulators on the other side. Filters are formed by configuring the metal and insulation layers to form capacitive π-networks and spiral inductors. Swanson U.S. Pat. No. 5,175,518 entitled "Wide Percentage Band With Microwave Filter Network and Method of Manufacturing Same" discloses a lumped-element thin-film based structure. Specifically, an alumina substrate has a ground plane on one side and multiple layer plate-like structures on the other side. A silicon nitride dielectric layer is deposited over the first plate on the substrate, and a second and third capacitor plates are deposited on the dielectric over the first plate.

Historically, such lumped element circuits were fabricated using normal, that is, non-superconducting materials. These materials have an inherent loss and, as a result, the circuits have various degree of lossiness. For resonant circuits, the loss is particularly critical. The Q of a device (assumed to be "unloaded" throughout this document) is a measure of its ability to store energy and thus inversely related to its power dissipation or lossiness. Resonant circuits fabricated from printed normal metals have Q's at best on the order of a few hundred.

With the discovery of high temperature superconductivity in 1986, attempts have been made to fabricate electrical devices from these materials. The microwave properties of the high temperature superconductors have improved substantially since their discovery. Epitaxial superconductive thin films are now routinely formed and commercially available. See, e.g., R. B. Hammond, et al., "Epitaxial $Tl_2Ca_1,Ba_2Cu_2O_8$Thin Films With Low 9.6 GHz Surface Resistance at High Power and Above 77 K", Appl. Phys. Lett., Vol. 57, pp. 825–27, 1990. Various filter structures and resonators have been formed. Other discrete circuits for filters in the microwave region have been described. See, e.g., S. H. Talisa, et al., "Low-and High-Temperature Superconducting Microwave Filters," IEEE Transactions on Microwave Theory and Techniques, Vol. 39, No. 9, September 1991, pp. 1448–1554.

The need for compact, reliable narrow-band filters has never been stronger. Applications in the telecommunication fields are of particular importance. As more users desire to use the microwave band, the use of more narrow-band filters helps to increase the number of users in the spectrum. The area from 700 to 2,000 MHz is of particular interest. In the United States, the 800 to 900 MHz range is used for analog and digital cellular communications. The personal communications services (PCS) are in the 1,800 to 2,000 MHz range.

Many passive microwave devices, for example, resonators, filters, antennas, delay lines, and inductors, have been fabricated in planar form utilizing high temperature superconducting thin films. As described, such structures are often smaller than conventional technologies in terms of physical size. However, these devices are also limited in their size given the constraints of fabricating high quality, epitaxial films. As a result, devices fabricated in HTS films are often of a quasi-lumped element nature, that is, where the nominal size the device is smaller than the wavelength of operation. This often results in folding of devices, which leads to significant coupling between lines.

Despite the clear desirability of improved electrical circuits, including the known desirability of converting circuitry to include superconducting elements, efforts to date have not always been satisfactory. It has proved to be difficult in substituting high temperature superconducting materials to form circuits without degrading the intrinsic Q of the superconducting film. These problems include circuit structure, radiative loss and tuning, and have remained in spite of the clear desirability of an improved circuit. Some of these problems have been overcome by the inventions discloses in U.S. patent application Ser. Nos. 5,888,942 and 6,026,311. However, there is still room for further improvements of relatively high Q and reduced intermodulation distortion (IMD) of electric filters in general. This need is particularly applicable to superconducting electric filters used in, for example, wireless telecommunication systems such as cellular communications base-station and mobile-station transceivers.

While relatively only small losses occur in many superconducting filters, superconducting filters are inherently nonlinear systems. Filter nonlinearities can limit the intermodulation intercept point of, for example, a base-station receiver to values that are too small for certain demanding applications. For example, sometimes conventional superconducting filters cannot be effectively used in wireless telecommunication networks where the base stations are co-located with strong specialized mobile radio (SMR) transmitters or with other cellular/PCS service providers because the power levels of out-of-band signals from these other systems can be too high and can result in IMD that reduces the receiver sensitivity. As a result, the superconducting filters are unable to adequately filter out the undesired out-of-band signals. The performance of the filter also changes with manufacturing process variations of the resonators and filters. Although some filters might be manufactured to achieve the required filtering capabilities for filtering out competing system out-of-band signaling, many of them would fail in such applications and are thus sorted out during testing, resulting in low filter manufacturing yields. Therefore, there is a need to improve electric filters design so that they operate with reduced IMD, and result in increased manufacturing yield.

SUMMARY OF THE INVENTION

The present invention is directed to electric filters with improved intermodulation distortion characteristics and a method for designing such electric filters. In general, the invention includes a multiple stage or pole (e.g., multi-resonator) electric filters in which one or more of the stages have been intentionally designed to have different electrical performance characteristics (e.g., signal filter performance) than the other resonators in the electric filter. In one case, the electric filters include multiple resonators coupled together with at least two of the multiple resonators having an intermodulation intercept point (IP) and/or Q different from one another. The relative Q and IP of the respective resonators may be determined by the relative strength of in-band and out-of-band signals expected in the application. The performance and cost of the electric filter may be optimized by designing the filter to have a relative Q and IP required by the particular application.

In one embodiment, the electric filter is a multi-resonator superconducting filter useful in, for example, wireless communication systems. The design of the filter assembly is determined by identifying those critical resonators that have the greatest impact on intermodulation distortions and losses and altering those critical resonators to minimize the intermodulation-distortion products while still maximizing Q. The superconducting filter may be, for example, a multi-resonator Chebyshev band-pass filter in which the first, and possibly the last, resonators have a different nth-order intercept point ($IP_n$) and/or Q. For example, the intermodulation intercept point of the filter can be increased by many orders of magnitude by increasing the $IP_n$ of the first resonator of the multi-resonator Chebyshev band-pass filter assembly. The first resonator may have lower Q relative to the other resonators, if the filter IP can be made higher with minimal degradation of the overall filter Q. Further, the last resonator may have low Q and low $IP_n$. All other resonators may have high Q and high $IP_n$. This combination of resonators is most advantageous for situations where the out-of-band signals are strong and the in-band signals are moderately strong to strong. In one variation the multiple resonators may be coupled in series and each resonator may comprise a set of capacitors and an inductor. Using this design approach a multi-resonator filter may be created which has reduced IMD with relatively high Q on average.

In another embodiment, the filter may be designed for situations in which the out-of-band signals are strong and the in-band signals are weak. In this case, the filter may have the best performance and cost with a high IP if the Q is low and the $IP_n$ is high for the first resonator of the multi-resonator Chebyshev band-pass filter assembly. Further, the last resonator may have low Q and low $IP_n$ while all other resonators may have high Q and low $IP_n$.

In a still further embodiment, the filter may be designed for situations in which the out-of-band signals are moderately strong and the in-band signals are moderately strong. In this case, the filter may have the best performance and a high IP if the Q is low and the $IP_n$ is high for the first resonator of the multi-resonator Chebyshev band-pass filter assembly. Further, the last resonator may have low Q and low $IP_n$ while all other resonators may have high Q and high $IP_n$.

In an even further embodiment, the filter may be designed for situations in which the out-of-band signals are weak to moderately strong and the in-band signals are weak. In this case, the filter may have the best performance and cost with a high IP if the Q is low and the $IP_n$ is low for the first resonator of the multi-resonator Chebyshev band-pass filter assembly. Further, the last resonator may have low Q and low $IP_n$ while all other resonators may have high Q and low $IP_n$.

The approach taught by the present invention for designing multi-stage filters may be most powerful in applications in which only a few resonators compromising the filter could be changed because of physical size limitations of the filter in the application. Further, this design approach may be used to enable use of new resonator designs that have superior properties when used in a small number of poles (e.g., 2–3 poles) but which would lead to unfeasible features when many of them are used, as in higher order filters (e.g., 4 or more poles). The design approach of the present invention may also be beneficial when only resonators with given, although different, electrical performance characteristics are available. For example, some resonators having low Q and a low $IP_n$ might still be used in the filter assembly. As such, the design approach of the present invention may specify how each of the various stages in a filter should be designed or assembled using, for example, particular individual resonators having particular electrical performance properties, so that (1) the filter performance may be improved, (2) the variability in the manufacturing process may be reduced, and (3) the yield of the manufacturing process may be increased. The invention, although explained using superconducting filters, applies equally well to any filter structures that are nonlinear and/or lossy.

BRIEF DESCRIPTION OF THE DRAWINGS

FIG. 8 is a chart indicating the relative Q and $IP_n$ of various resonators for achieving, for example, an improved IMD multi-stage electric superconducting band-pass filters for variations in the relative strength of out-of band signals and in-band signals, according to one embodiment of the present invention.

DESCRIPTION OF THE PREFERRED EMBODIMENTS

Figure 1:
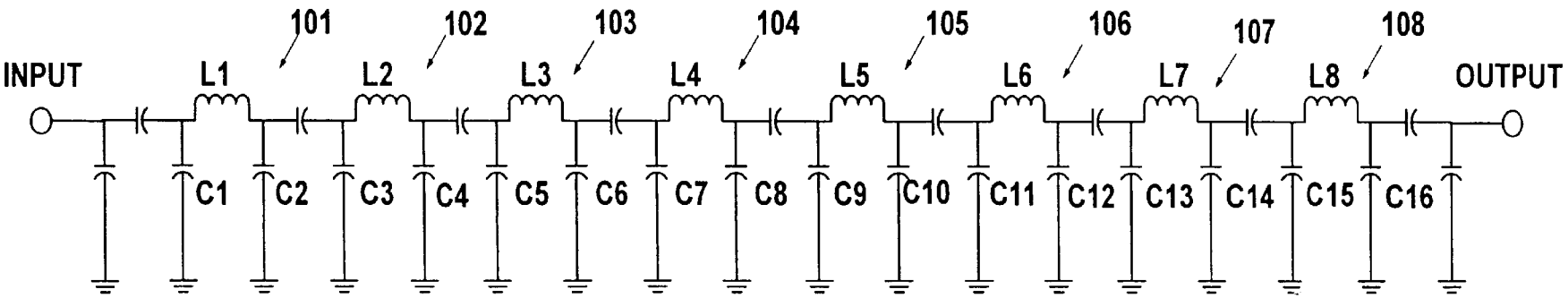
Figure 1 (Prior Art)
FIG. 1 is a circuit diagram of an exemplary eight-pole Chebyshev band-pass filter.

Conventional multi-stage filters have been designed using a series of individual resonators each designed to achieve the same Q and nth-order intermodulation intercept point ($IP_n$). An intermodulation intercept point is a point where the power of an extrapolated intermodulation-distortion component and the linear output power are equal. The input power level when this happens is referred to as an IP value. If the exponent of the power dependence of the IMD product on the input power is n, the IP value is denoted by $IP_n$ and they are called as nth-order IMD products. The exponent n may be, but need not be, an integer. Although conventional multistage resonators may be designed so that each resonator has the same Q and $IP_n$, individual resonators may experience some variations during manufacturing, but these variations have not been considered desirable. The present invention, on the other hand, takes advantage of selecting resonators having different Q and $IP_n$. The invention is not limited to resonators and filters that can only be classified in terms of the intercept point but applies to other parametrizations that characterize the magnitude of IMD products which may not be amenable to the use of the IP concept.

In the case of superconducting filters in wireless communication systems, both the Q and $IP_n$ are typically designed to be as high as possible so as to be able to pass a desired signal while filtering out all other signals. Sufficient filter performance has become more difficult as the desired frequencies have become more and more limited (e.g., very narrow pass-bands) with increased wireless communication traffic. While only small losses occur in superconducting filters, they are nonetheless inherently nonlinear systems. Filter nonlinearities limit the intermodulation intercept point of the filters to values that are too small for certain applications. In general, the higher the intercept point, the lower the IMD power, and the better the ability to filter out undesired frequencies. Too low of an IP is a problem when, for example, power levels of out-of-band signals are high. In such a case, conventional multi-stage superconducting filters having all the resonators designed with the same high Q and high $IP_n$ cannot easily be used in wireless telecommunication networks where a base station including the filters (e.g., in the receivers) are co-located with strong SMR transmitters or with other cellular/PCS service providers. Ideally, each of the resonators in a multi-stage band-pass filter in such a case should have high Q and high $IP_n$ so as to produce the highest Q and least amount of IMD possible. However, this leaves very little design flexibility for the filter assembly to accommodate other design considerations such as the size of the filter, the coupling between the filters, resulting manufacturing yield, etc. For example, in microwave applications of microstrip superconducting filters, the size of the filter may be of a concern because of size limitations related to the available space in base stations, to the size of dielectric-substrate wafers and variations in resonator characteristics across the wafer. Further, filters may be designed with resonators having different Q and $IP_n$ values for improved power-handling capabilities. Also, if variation in the individual resonator Q values is acceptable then filters with higher $IP_3$ may be created.

Contrary to the conventional wisdom of multi-stage filter design, the present invention provides for designing multi-stage (e.g., resonator) electric filters in which one or more of the resonators have been intentionally altered to have a higher $IP_3$ and possibly a lower Q than the other resonators in the electric filter. The desired relative Q and IP of the respective resonators depends on the relative strength of in-band and out-of-band signals. The performance and cost of the electric filter may be optimized by designing the filter to have a relative Q and IP required by the particular application. Analysis of the intermodulation distortion (IMD) contribution of each resonator in the multi-stage filter helps determine which of the resonator(s) has the most effect on the IMD and insertion loss, and thus which resonator(s) may be altered to improve the overall $IP_n$ and/or Q for the filter. Various exemplary analysis and designs follow.

Figure 2:
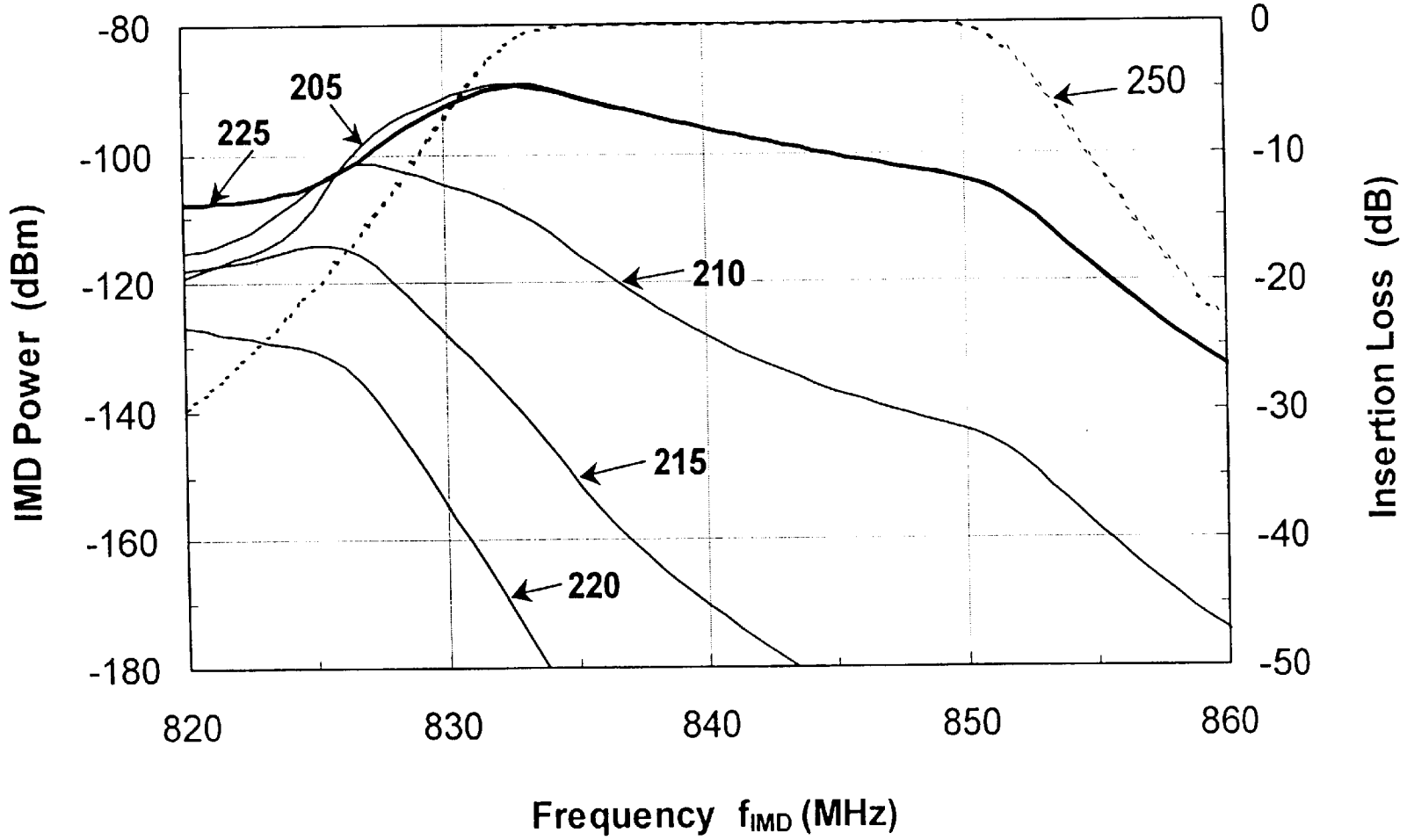
FIG. 2 is a graph of the IMD power of the lower side band as a function of the IMD spur (tone) frequency for a 4-pole Chebyshev narrow band-pass filter, the individual contributions to the total IMD for each respective resonators of the 4 poles, and the insertion loss of the filter where the input frequencies are swept with a fixed 25 MHz spacing, according to an analysis that supports the design methodology of the present invention.

Referring to FIG. 2, analysis of, for example, a superconducting 4-pole Chebyshev narrow band (B-band) band-pass filter having a desired passband of 835–849 MHz is provided for consideration. The design of the improved filter assembly may be determined by identifying those critical resonators that have the greatest impact on intermodulation distortions and losses and altering those critical resonators to minimizes the intermodulation-distortion products while still maximizing Q. The analysis is performed using two input tones to generate IMD power performance curves. The graph in FIG. 2 includes traces for the IMD power of the lower side band as a function of the IMD spur (tone) frequency for the 4-pole Chebyshev filter. Each pole of the filter corresponds to a resonator, and the resonators may be coupled in series or in parallel and referred to herein as the first, second, third, . . . to n'th resonators starting from the input of the filter. The traces for individual resonator contributions to the total IMD power are separated such that the first resonator IMD power contribution is shown by curve 205, the second resonator IMD power contribution is shown by curve 210, the third resonator IMD power contribution is shown by curve 215, and the fourth resonator IMD power contribution is shown by curve 220. The total IMD power is shown as curve 225. In this case, the input tone frequencies are swept keeping the tone spacing fixed at 25 MHz separation and the input power of each signal tone is 0 dBm. As illustrated, the first resonator IMD power curve 205 and the second resonator IMD power curve are stressed the most in terms of the total IMD power curve 225, demonstrating the importance of the resonators closest to the input. Also shown is curve 250 illustrating the insertion loss of the filter.

Figure 3:
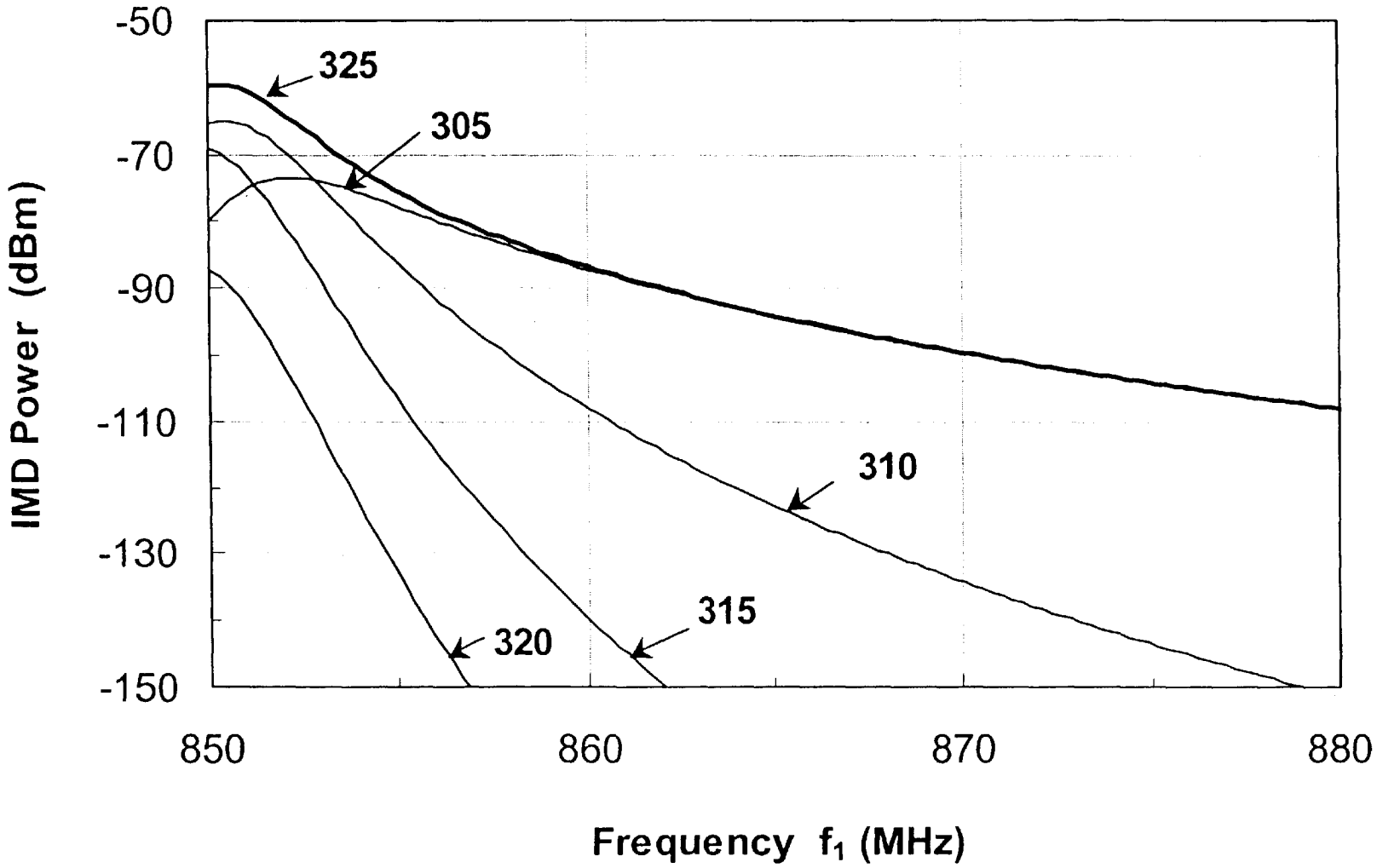
FIG. 3 is a graph of the IMD power of the lower side band as a function of the IMD first tone frequency while keeping the frequency of the lower IMD side band fixed at 849 MHz for a 4-pole Chebyshev narrow band-pass filter, the individual contributions to the total IMD for each respective resonators of the 4 poles being shown separately, according to an analysis that supports the design methodology of the present invention.

FIG. 3 provides another assessment of the IMD power handled by the various resonators of the superconducting 4-pole Chebyshev narrow band (B-band) band-pass filter having a desired passband of 835–849 MHz. In this case the graph provides IMD power as a function of the frequency of the first tone while keeping the frequency of the lower IMD side band fixed (849 MHz) for a 4-pole B-band filter. Again, the IMD power contributions of individual resonators are separated and the total IMD power is provided. The first resonator IMD power contribution is shown by curve 305, the second resonator IMD power contribution is shown by curve 310, the third resonator IMD power contribution is shown by curve 315, the fourth resonator IMD power contribution is shown by curve 320, and the total IMD power for the filter is shown as curve 325. The input power of the each of the two tones is 0 dBm.

The graphs in FIG. 2 and FIG. 3 illustrate the importance of the resonators closest to the input of the filter in eliminating the IMD products. The first few resonators are stressed the most in terms of IMD. Thus, a high intercept point (e.g., $IP_3$) for the first few resonators is important in removing the IMD experienced by a superconducting 4-pole Chebyshev narrow band (B-band) band-pass filter having a desired passband of 835–849 MHz.

Figure 4:
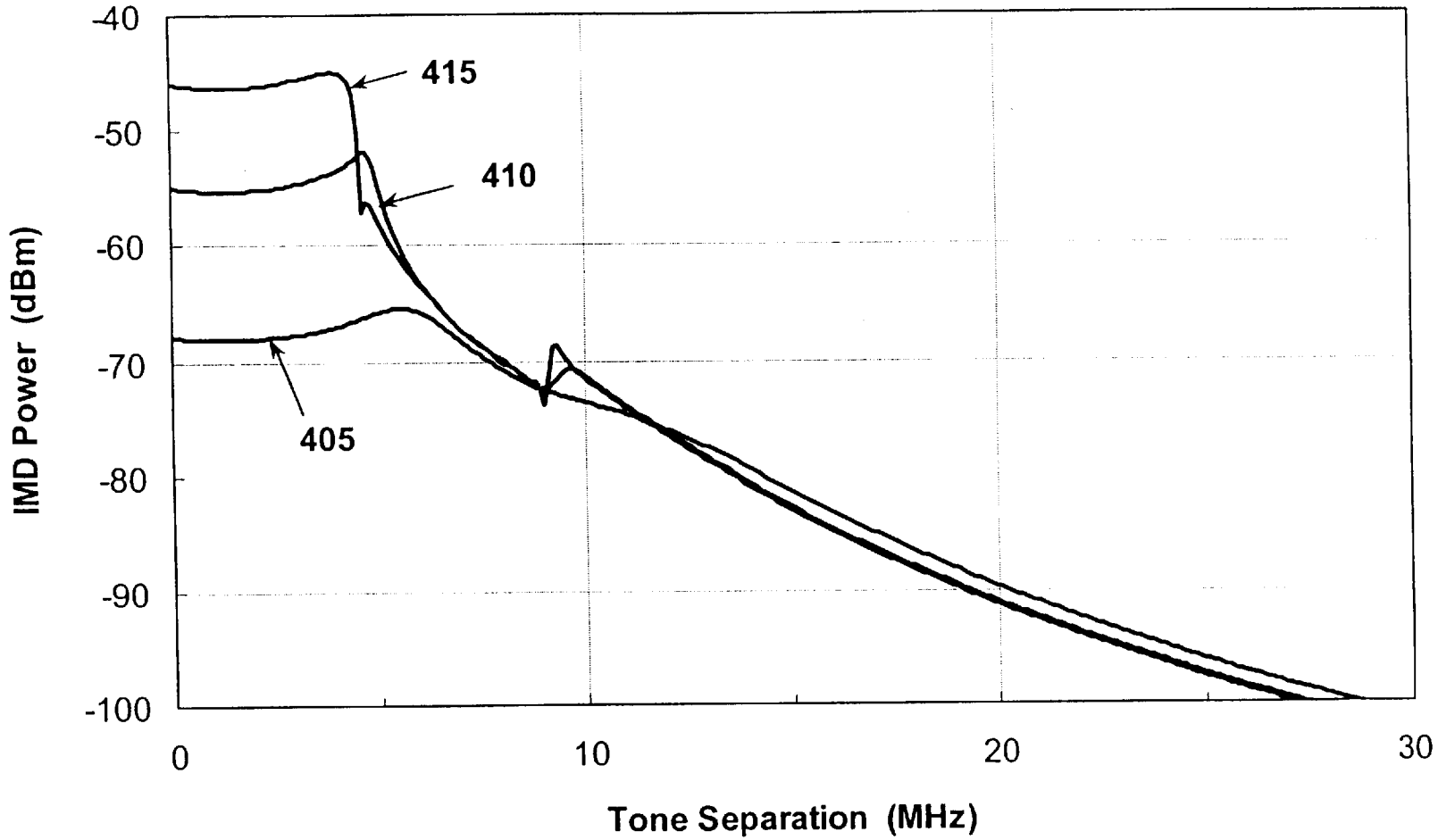
FIG. 4 is a graph of the IMD power of the lower side band as a function of the tone frequency separation of a 4-pole, 8-pole, and 16-pole Chebyshev narrow band-pass filters, respectively, according to an analysis that supports the design methodology of the present invention.

Referring now to FIG. 4, the IMD power of the lower side band as a function of the tone frequency separation for superconducting 4-pole, 8-pole, and 16-pole Chebyshev narrow band-pass filters, respectively, are graphed. The two signal tones are chosen so that the lower IMD side band is fixed at 840 MHz. Curve 405 represents the 4-pole filter IMD power, curve 410 represents the 8-pole filter IMD power, and curve 415 represents the 16-pole filter IMD power. In this case, it is demonstrated that the number of filter poles does not affect significantly the out-of-band intermodulation performance of the filter because it is dominated by at least the first resonator. As can be seen the only distinction in the IMD power for each of the 4-pole (curve 405), 8-pole (curve 410), and 16-pole (curve 415) filters occurs when the tone separation is approximately 6 MHz or less. At tone separation frequencies above 10 MHz, the IMD filter performance is almost indistinguishable. As such, again the analysis indicates that most of the IMD products are produced by the first resonators closest to the input. On the other hand, the number of poles in the Chebyshev filter does sufficiently affect the out-of-band insertion loss of the filter.

Figure 5:
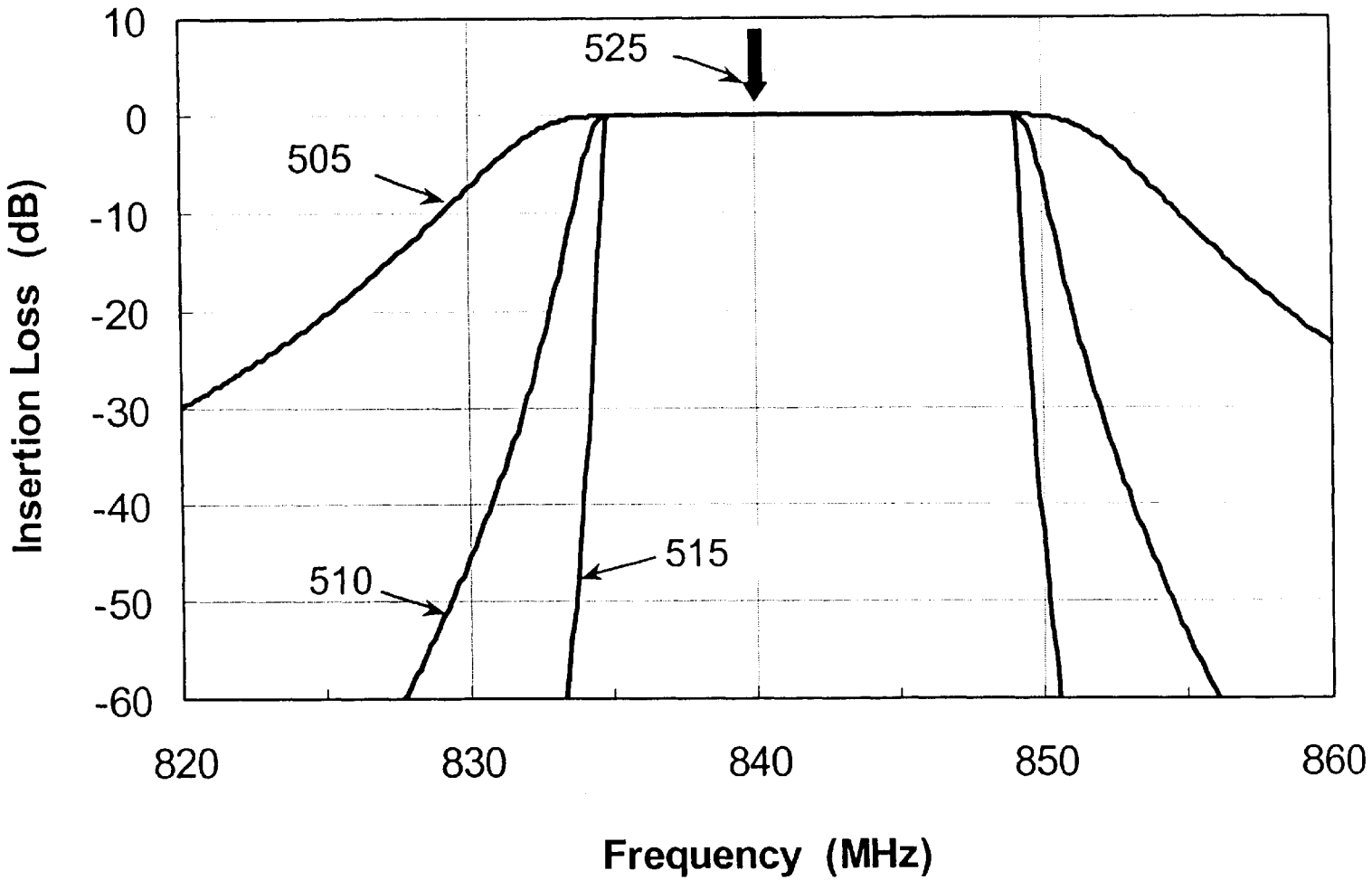
FIG. 5 is a graph of the insertion loss of respective 4-pole, 8-pole, and 16-pole Chebyshev narrow band-pass filters as a function of frequency, according to an analysis that supports the design methodology of the present invention.

FIG. 5 provides a graph of the insertion loss of respective superconducting 4-pole, 8-pole, and 16-pole Chebyshev narrow band-pass filters as a function of frequency. The arrow 525 marks the frequency of the lower IMD side band of 840 MHz used in FIG. 4 and the filter's designed passband is 835–849 MHz. Curve 505 represents the 4-pole filter insertion loss, curve 510 represents the 8-pole filter insertion loss, and curve 515 represents the 16-pole filter insertion loss. As can be understood from this graph, the number of poles does affect the insertion loss rather than the insertion loss being dominated by resonators close to the input. In fact, as shown in the next figure, the insertion loss is less affected by the resonators near the input and output of the superconducting Chebyshev narrow bandpass filter.

Figure 6:
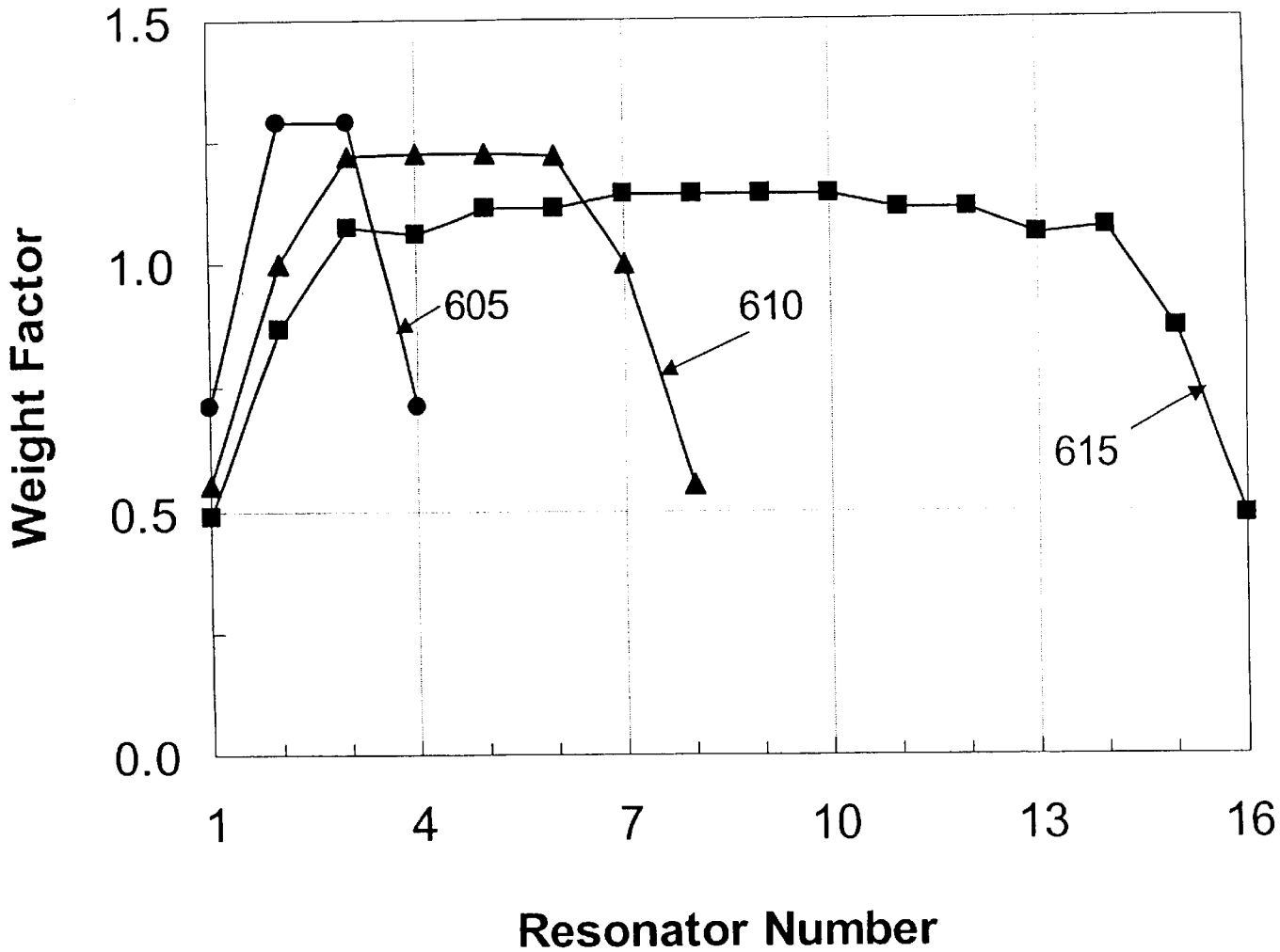
FIG. 6 is a graph of the insertion loss of individual resonators for each of the 4-pole, 8-pole, and 16-pole Chebyshev narrow band-pass filters, according to an analysis that supports the design methodology of the present invention.

Referring now to FIG. 6, a graph of the insertion loss of individual resonators for each of the superconducting 4-pole, 8-pole, and 16-pole Chebyshev narrow band-pass filters is provided. Shown are the contributions of each of the individual resonators to the total insertion loss. Curve 605 shows the relative insertion loss contribution for each of the four resonators in a superconducting 4-pole Chebyshev narrow band-pass filter. Curve 610 shows the relative insertion loss contribution for each of the four resonators in a superconducting 8-pole Chebyshev narrow band-pass filter. Curve 615 shows the relative insertion loss contribution for each of the four resonators in a superconducting 4-pole Chebyshev narrow band-pass filter. In each case, the resonators closest to the input and output ports affect the insertion loss the least. The weight factor is defined as $$w_i = pL_i \Big/ \sum_{i=1}^{p} L_i,$$

where p is the number of resonators (poles) and $L_i$ is the portion of the insertion loss due to the ith resonator.

Analysis of the graphs in FIGS. 2–6 helps to identify in superconducting filters whose critical resonators that have the greatest impact on intermodulation distortions and the least on insertion loss and suggests developing asymmetric filters that minimize the intermodulation-distortion products and maximizes Q. As described above, individual resonators compromising the filter have a very different effect on the overall intermodulation performance of the filter. In particular, the first resonator closest to the input is most influential on determining the out-of-band intercept point as indicated particularly by FIGS. 2–4. Further, the first resonator has the least effect on the insertion loss, and therefore on Q, as illustrated by FIGS. 5–6. The first resonator closest to the input is stressed the most in terms of intermodulation distortions and the least in terms of losses. Therefore, the first resonator may be a lossy resonator and still have a filter that has on average a high Q and high $IP_3$. For example, in cases where the out-of-band signals and the in-band signals are both relatively strong, the first resonator may be designed to have a relatively low Q and relatively high $IP_3$ and result in a filter in which the intermodulation intercept point may be increased by many orders of magnitude with minimal degradation of Q. Improvements in the resonator design intended to increase $IP_3$ may also increase Q. For example, the present invention may utilize first resonators with the $IP_3$ value of 40 dBm and Q of 100,000 as opposed to values of 20 dBm and 40,000 used in a conventional filter. In this case, when the first resonator is less sensitive to high-power out-of-band signals, the intercept point of the filter is raised by orders of magnitude.

Figure 7:
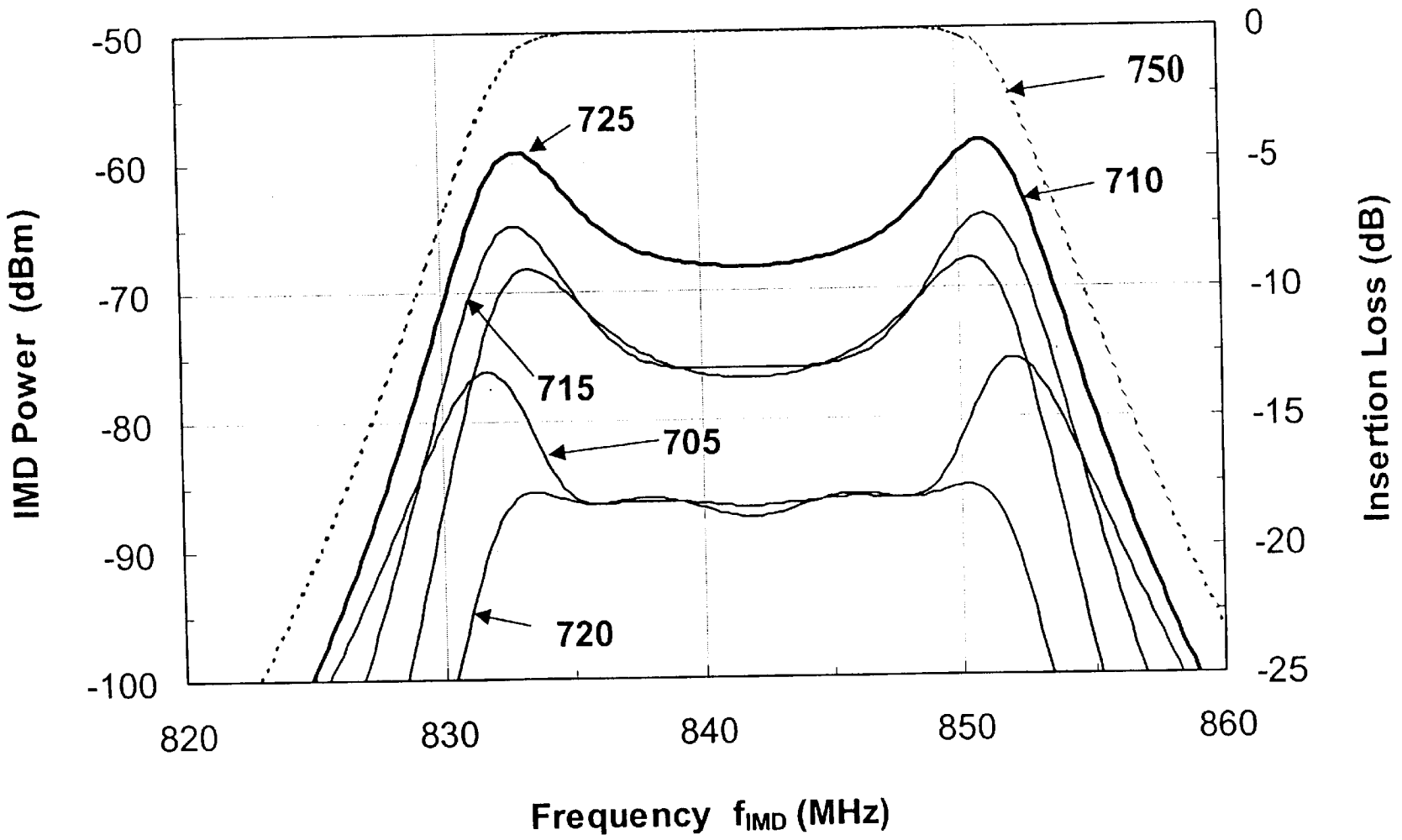
FIG. 7 is a graph of the IMD power of the lower side band as a function of the IMD spur (tone) frequency for a 4-pole Chebyshev narrow band-pass filter in which in-band signals are of interest, the individual contributions to the total IMD for each respective resonators of the 4 poles, and the insertion loss of the filter where the input frequencies are swept with a fixed 30 kHz spacing, according to an analysis that supports the design methodology of the present invention.

On the other hand, if in-band signals are of interest, the first and the last resonator would be less important in determining IMD. Referring to FIG. 7, a graph of the IMD power of the lower side band as a function of the IMD spur (tone) frequency for a 4-pole Chebyshev narrow band-pass filter is provided. In this case the individual contributions to the total IMD for each respective resonators of the 4 poles is quite different. In this case, the IMD power of the first resonator illustrated by curve 705 is not the most critical. Rather, the IMD power of the second and third resonators illustrated by curves 710 and 715, respectively, are the most critical making the largest contributions to the total IMD illustrated by curve 725. The fourth resonator has the least contribution to the total IMD as illustrated by curve 720. The insertion loss is illustrated by curve 750. In this analysis, the input frequencies are swept with a fixed 30 kHz spacing.

As previously noted it is optimal to have all resonators with the highest possible Q and $IP_3$. However, in many cases, this is impossible because other design considerations may prohibit this (e.g., the size of the wafer, couplings between resonators, etc.). The present invention recognizes that, depending on the frequencies of the input tones, the dominant IMD products are generated in different resonators within multi-stage filters. Therefore, the present invention provides the framework for allowing reductions in the Q and/or IMD capability of one or more resonators of a multi-stage filter, while attaining a filter with high Q and minimizing the out-of-band (or in-band) IMD products and losses.

Referring now to FIG. 8, a chart is provided indicating some exemplary filter embodiments with the relative Q and $IP_n$ of various resonators for achieving improved IMD multi-stage electric superconducting band-pass filters for variations in the relative strength of out-of band signals and in-band signals. The relative relationships shown in FIG. 8 may also apply to other types of filters. In any case, the first scenario, listed in the chart as row 805, shows one possible set of design criteria for a multi-stage filter where the out-of-band signals are relatively strong and the in-band signals are strong to moderately strong. In this situation, the first resonator may have a low Q and high $IP_n$. The middle resonators may have a high Q and high $IP_n$. The last resonator has maximum flexibility and may have, for example, a low Q and a low $IP_n$. In, for example, microwave applications, input signal power levels may be considered strong if they are above approximately −10 dBm, moderately strong above approximately −30 dBm but below approximately −10 dBm, and weak below approximately −30 dBm. Further, for microwave applications, a low Q may be less than approximately 10,000, a high Q may be greater than approximately 10,000, a low $IP_3$ may be less than approximately 20 dBm and a high $IP_3$ may be greater than approximately 20 dBm.

The second scenario, listed in the chart as row 810, shows one possible set of design criteria for a multi-stage filter where the out-of-band signals are relatively strong and the in-band signals are relatively weak. In this situation, the first resonator may have a low Q and high $IP_n$. The middle resonators may have a high Q and low $IP_n$. The last resonator again has maximum flexibility and may have, for example, a low Q and a low $IP_n$. The third scenario, listed in the chart as row 815, shows one possible set of design criteria for a multi-stage filter where the out-of-band signals are moderately strong and the in-band signals are moderately strong. Although moderately strong, the out-of-band signals are sufficiently strong relative to the in-band signals so that filtering is needed. In this situation, the first resonator has maximum flexibility and may have, for example, a low Q and low $IP_n$. The middle resonators may have a high Q and high $IP_n$. The last resonator again has maximum flexibility and may have, for example, a low Q and a low $IP_n$. The fourth scenario, listed in the chart as row 820, shows one possible set of design criteria for a multi-stage filter where the out-of-band signals are weak to moderately strong and the in-band signals are relatively weak. Once again, although weak to moderately strong, the out-of-band signals are sufficiently strong so that filtering is needed. Again, the first resonator has maximum flexibility and may have, for example, a low Q and low $IP_n$. The middle resonators may have a high Q and low $IP_n$. The last resonator again has maximum flexibility and may have, for example, a low Q and a low $IP_n$. In all cases, the Q requirements are independent of power levels.

Figure 9:
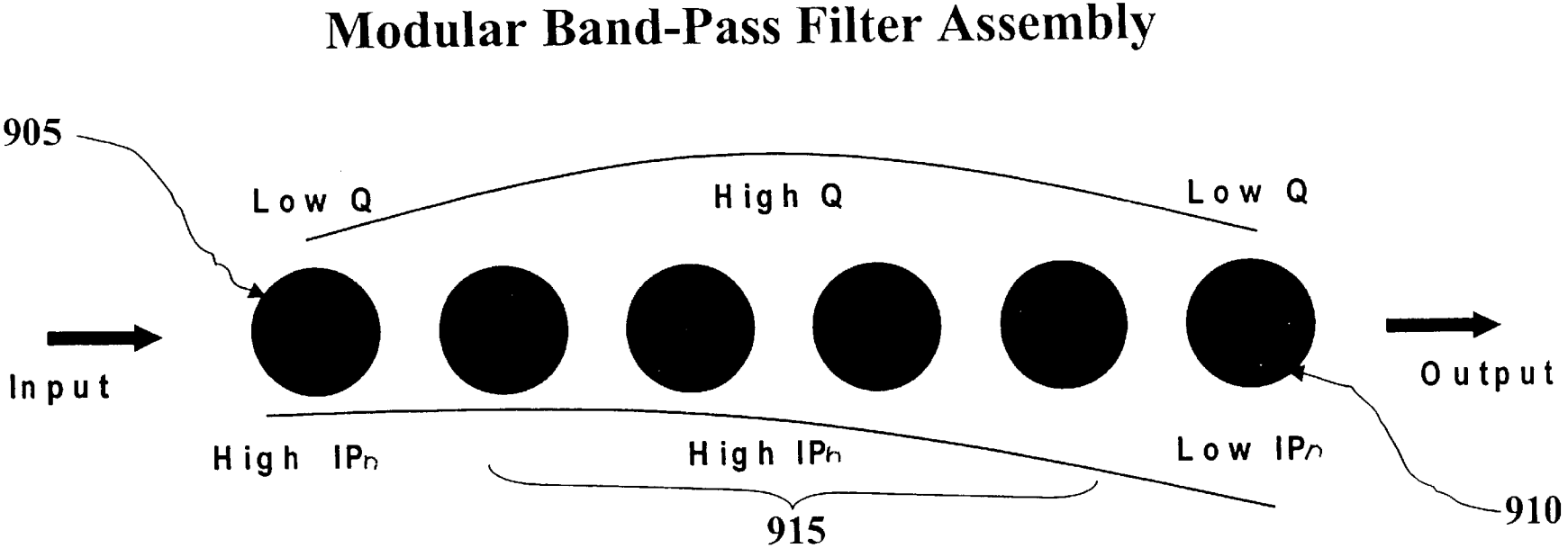
FIG. 9 is a diagram of an exemplary modular band-pass filter assembly that has improved filter performance due to higher Q and $IP_3$ on average and reduced performance variability with increased filter manufacturing yield, according to another embodiment of the present invention.

Using the first scenario, a diagram of one exemplary modular band-pass filter assembly that has improved filter performance due to higher Q and $IP_n$ on average and reduced performance variability with increased filter manufacturing yield is illustrated in FIG. 9. This diagram shows how the order of the resonators in the filter may be designed and assembled so as to minimize out-of-band IMD products and losses. As indicated by the diagram, in this embodiment the multi-resonator superconducting filter may be, for example, a multi-resonator Chebyshev band-pass filter in which the first resonator 905 and the last resonator 910 have different Q and/or a nth-order intercept point ($IP_n$) than the middle resonators 915. In this case, the intermodulation intercept point of the filter can be increased by many orders of magnitude with minimal degradation of Q by lowering the Q and increasing the $IP_3$ of the first resonator 905 of a multi-resonator Chebyshev band-pass filter assembly. Further, as indicated, the last resonator may have low Q and low $IP_n$. Although, the Q and $IP_n$ of the last resonator is very flexible and may be of any relative strength. The middle resonators 915 may have, for example, high Q and high $IP_n$. As noted previously, this combination of resonators is most advantageous for situations where the out-of-band signals are strong and the in-band signals are strong to moderately strong. In one variation, the multiple resonators may be coupled in series and each resonator may comprise a set of capacitors and inductor. Further, in another variation, the number of middle resonators may be any integer value. Using this design approach a non-random assembly of the band-pass filter resonators may be used and result in multi-resonator filters which have improved filter performance in reduced IMD with relatively high Q on average. This non-random filter assembly approach may also reduce the filter-to-filter variability of Q and $IP_{nx}$ as well as increase the filter yield in manufacturing because not all resonators in a filter will need to achieve a high Q and high $IP_n$.

Figure 10:
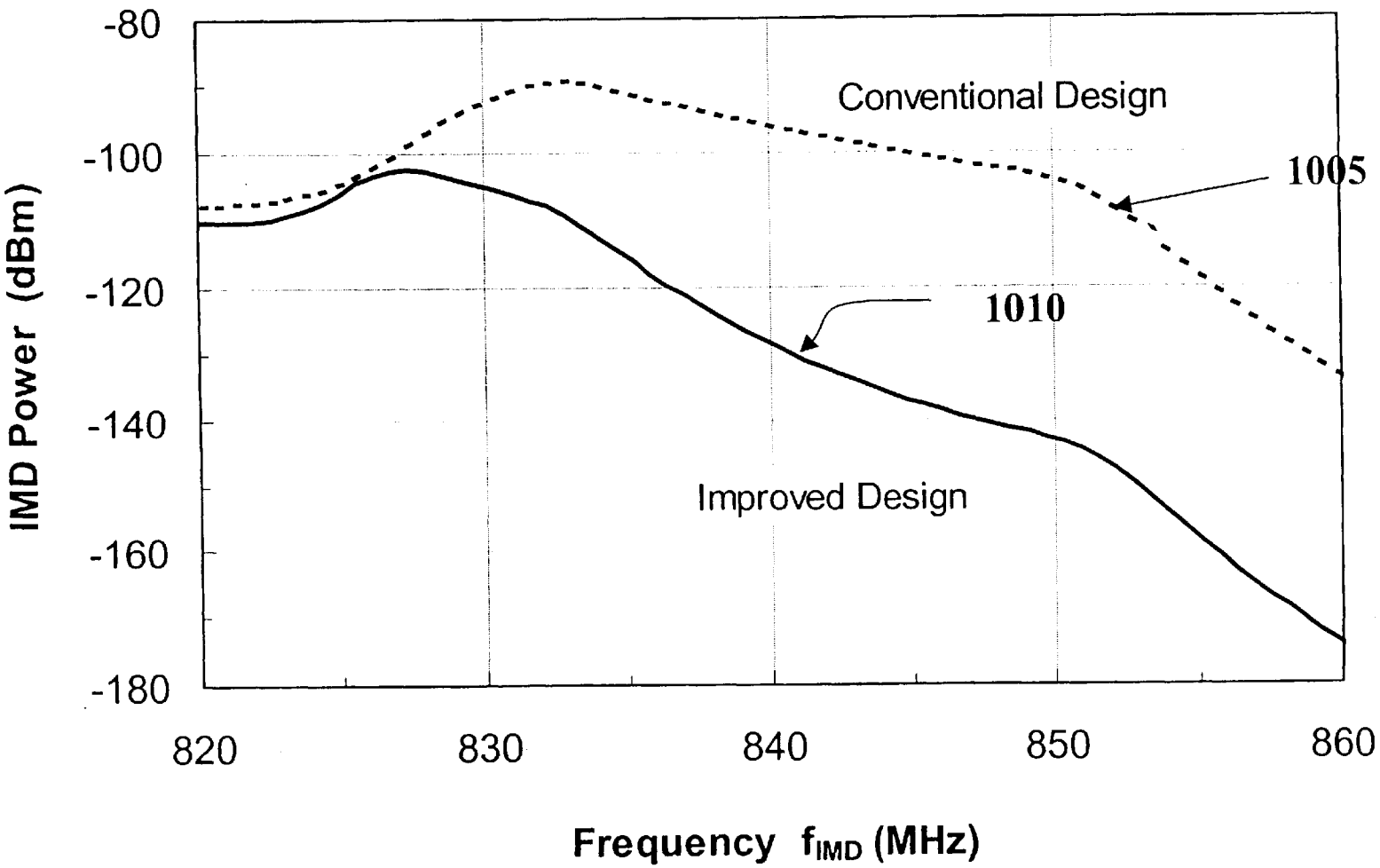
FIG. 10 is a diagram of the improvement in IMD for an exemplary 4-pole Chebyshev narrow band-pass filter assembly that has improved filter performance due to higher $IP_3$ for the first resonator of the filter, according to another embodiment of the present invention.

In another embodiment, a superconducting 4-pole Chebyshev filter is created in which the first resonator has a very high $IP_3$ compared to the other three resonators. Referring to FIG. 10, each curve, 1005 and 1010, represents the IMD power of the lower side band as a function of the IMD spur frequency for the superconducting 4-pole Chebyshev filter, where the two input tone frequencies are swept at tones fixed 25 MHz apart from one another and the input power of each tone is 0 dBm. The IMD power curve 1005 illustrates the performance of a conventional filter having all resonators designed to achieve relatively high Q and high $IP_3$ (the filter analyzed in FIGS. 2 and 3). The IMD power curve 1010 illustrates the performance of the improved filter design with the first resonator having a very high $IP_3$ above that of the resonators in the conventional filter. As illustrated, the IMD curve 1010 shows improved IMD performance.

The analysis undertaken and the design approach of the present invention indicate that for strong out-of-band signals the resonators closest to the filter input have the greatest impact on IMD and the least effect on Q and insertion loss. Further, the analysis suggests that the resonators closest to the output have the least impact on the insertion loss. On the one hand, this suggests that the last few resonators may be degraded in performance relative to the middle resonators without significantly affecting the average Q and IMD performance of the multi-stage filter for strong out-of band signal applications. On the other hand, the analysis also suggests a design methodology in which one or more of the first few resonators closest to the input of the filter may have improved IP and/or Q relative to the middle resonators so as to improve the overall IP and/or Q of the entire filter without changing the physical aspects and electrical characteristics of all of the resonators.

Thus, using the design methods derived from the prior described analysis for improved out-of-band MD as illustrated in FIGS. 2–6 and summarized in FIG. 10, one can understand that an improved IMD and/or Q performance multi-stage filter may be created by improving these characteristics of only one resonator, for example the first resonator. For example, the first resonator may be (1) replaced by a new design that utilizes different dimensions or excitation modes (fundamental vs. excited) than the rest of the resonators; (2) a separate unit; for example, in the case of microstrip-line filters, the first resonator can be a planar disk resonator that has a common ground with the other resonators or where they are stacked against each other (this is a particularly interesting option because disk resonators have degenerate modes that can be split allowing multi-mode operation); (3) made of linear material like a low-loss normal metal; and/or (4) made of a dielectric material and coupled to the filter by a planer coupling network. An exemplary planar disk resonator may be found in H. Chaloupka, M. Jeck, B. Gurzinski, and S. Kolesov, Electronics Letters 32, 1735 (1996). A particular example of a filter with a first resonator having a different $IP_3$ and/or Q than the other resonators is shown in FIG. 11.

Figure 11:
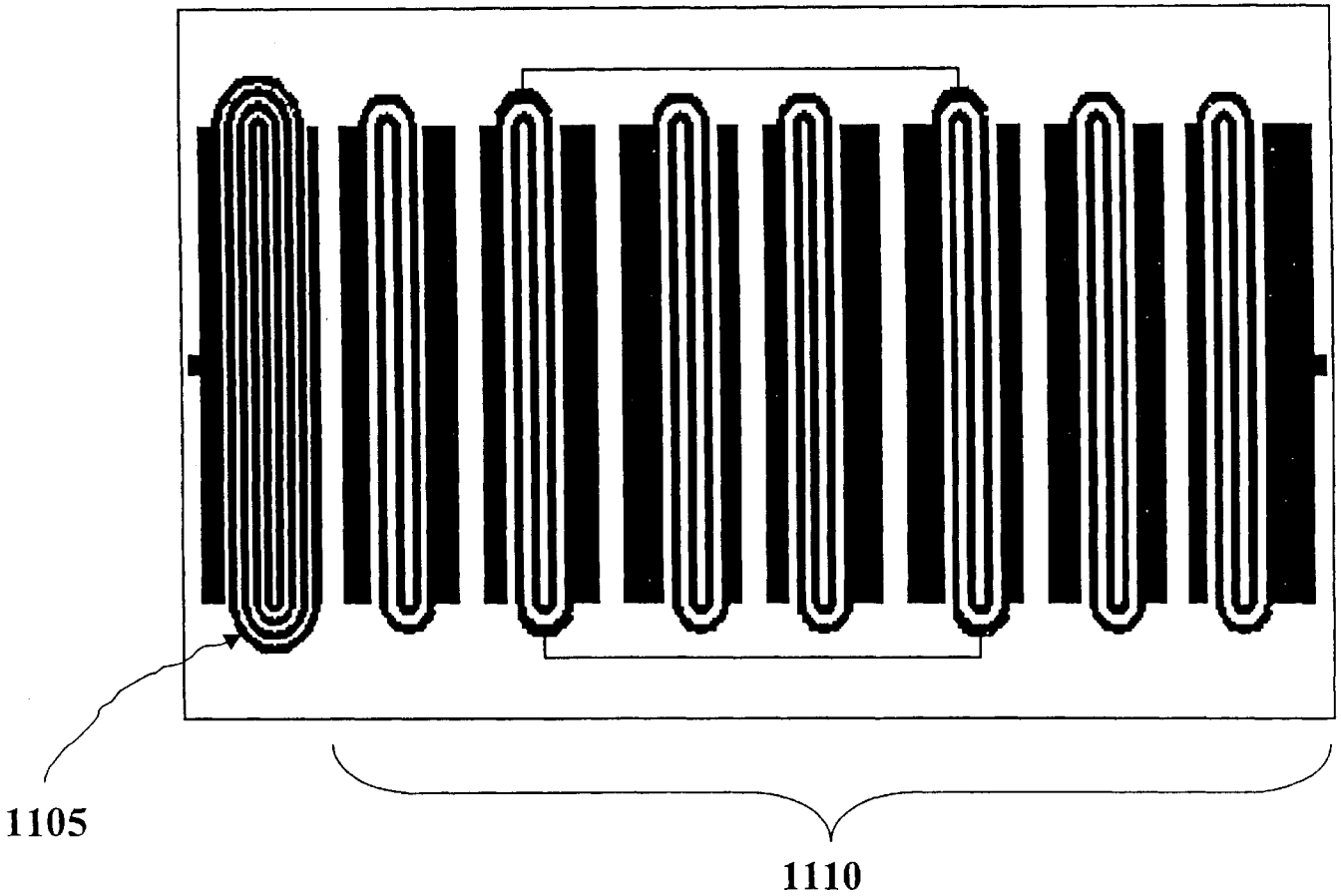
FIG. 11 is a plan view of the metalization for an 8-pole microstrip-line band-pass filter with improved IMD, according to a still further embodiment of the present invention.

Referring now to FIG. 11, a plan view of the metalization for one exemplary filter design shows an 8-pole microstrip-line band-pass filter having improved out-of band IMD performance. By using the results of the analysis for the scenario having strong out-of-band signals and strong in-band signals the filter design shown in FIG. 11 was developed. In this case, the first resonator 1105 has been changed to be different than the other seven resonators 1110. The first resonator has a longer spiral in, spiral out trace and operates in a second mode. As a result, the first resonator has higher Q and higher $IP_3$ than the other seven resonators 1110. In essence, the first resonator is less sensitive to the high-power (strong) out-of-band signals because its IP is raised by orders of magnitude. Further, notice that forming all 8 resonators the same as the first resonator 1105 would increase the size of the microstrip-line filter which in this case may be larger than what may be accommodated on the dielectric wafer substrate. Thus, in this embodiment the design methods result in a filter with improved $IP_3$ and Q relative to a conventional superconducting microstrip-line filter by modifying only the first resonator, without adding the addition substrate area for changing all the resonators in the multi-stage filter. A description of the details to the structure and design of a generic microstrip-line filter similar to the one shown in FIG. 11 may be found in U.S. Pat. No. 6,026,311, hereby incorporated by reference for all purposes.

Figure 12:
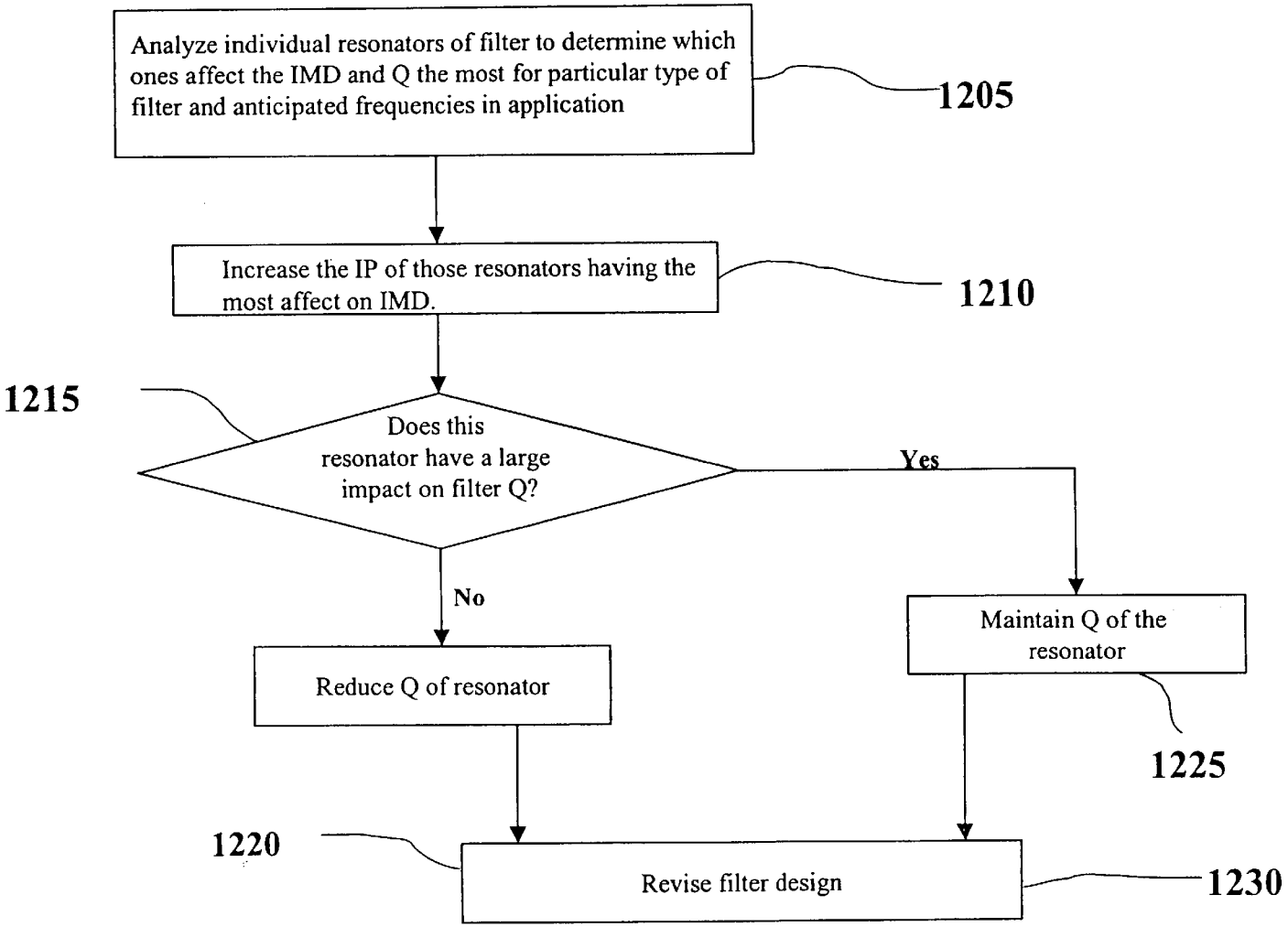
FIG. 12 is a flow chart illustrating one method for designing multi-stage electric filters to have improved IMD, according to one embodiment of the present invention.

Referring now to FIG. 12, a flow chart illustrating one method for designing multi-stage electric filters to have improved IMD is provided. First, in step 1205, an analysis is done of the individual resonator of a multi-stage filter to determine which resonators affect the IMD and Q the most for the particular type of filter and the anticipated frequencies experienced in the application of the filter. Next, at step 1210, the IP (e.g., $IP_3$) is increased for those resonators having the most affect on the IMD. Then, at decision step 1215, it is determined whether the resonator(s) having their IP increased also have a significant impact on the filter Q. If not, then at step 1220, the Q of this resonator may be reduced. If so, then at step 1225, the Q is maintained at the typical level. In either case, next at step 1230, the filter design is revised to increase the IP and/or Q.

Although the described embodiments have been primarily directed at the scenario where the out-of-band signals are strong, this scenario is only exemplary. As indicated in FIG. 8, the invention is more widely applicable to all variations of out-of-band and in-band signals. The type of signals for which to design the multi-stage filter is determined by the type of signals the filter will experience in a particular application. For example, the strong out-of-band signals scenario is derived from a filter application in which the filter is part of a base station receiver in a wireless communication system.

In another embodiment, the filter may be designed for applications in which the out-of-band signals are strong and the in-band signals are weak. In this case, the filter may have the best performance and cost with a high $IP_n$ if the Q is low and the $IP_n$ is high for the first resonator of the multi-resonator Chebyshev band-pass filter assembly. Further, the last resonator may have low Q and low $IP_n$ while all other resonators may have high Q and low $IP_n$.

In a still further embodiment, the filter may be designed for applications in which the out-of-band signals are moderately strong and the in-band signals are moderately strong. In this case, the filter may have the best performance and a high $IP_n$ if the Q is low and the $IP_3$ is high for the first resonator of the multi-resonator Chebyshev band-pass filter assembly. Further, the last resonator may have low Q and low $IP_n$ while all other resonators may have high Q and high $IP_n$.

In an even further embodiment, the filter may be designed for applications in which the out-of-band signals are weak to moderately strong and the in-band signals are weak. In this case, the filter may have the best performance and cost with a high $IP_n$ if the Q is low and the $IP_n$ is low for the first resonator of the multi-resonator Chebyshev band-pass filter assembly. Further, the last resonator may have low Q and low $IP_n$ while all other resonators may have high Q and low $IP_n$.

The approach taught by the present invention for designing multi-stage filters may be most powerful in applications in which only a few resonators compromising the filter could be changed because of physical size limitations of the filter in the application. Further, this design approach may be used to enable use of new resonator designs that have superior properties when used in a small number (e.g., 2–3 poles) but which would lead to unfeasible features when many of them are used, as in higher order filters (e.g., 4 or more poles). The design approach of the present invention may also be beneficial when only resonators with given, although different, electrical performance characteristics are available. For example, some resonators having low Q and a low $IP_n$ might still be used in the filter assembly. The use of these resonators helps improve filter costs and manufacturing yield. This is particularly beneficial when the resonators are discrete components because the individual resonators may be sorted during manufacturing according to Q, IP, etc., and may then be used in the appropriate location within the filter according to the present invention. Thus, the design approach of the present invention may specify how each of the various stages in a filter should be designed or assembled using, for example, particular individual resonators having particular electrical performance properties, so that (1) the filter performance may be improved, (2) the variability in the manufacturing process may be reduced because the best resonators are used where they have the greatest impact on the filter properties and the worst resonators may be used where they have the least impact on the filter properties, eliminating the extremes, and (3) the yield of the manufacturing process may be increased. The invention, although explained using superconducting filters, applies equally well to any filter structures that are nonlinear and lossy.

Although particular embodiments of the present invention have been shown and described, it will be understood that it is not intended to limit the invention to the particular embodiments and it will be obvious to those skilled in the art that various changes and modifications may be made without departing from the spirit and scope of the present invention. For example, the filter of the present invention may be any type of filter such as a band-pass filter, low-pass filter, high-pass filter, etc. Thus, the invention is intended to cover alternatives, modifications, and equivalents, which may be included within the spirit and scope of the invention as defined by the claims.

All publications, patents, and patent applications cited herein are hereby incorporated by reference in their entirety for all purposes.

What is claimed is:

1. A filter, comprising:

a plurality of resonators coupled together, at least two of said plurality of resonators are selected having known different values of intermodulation IP and at least two of said plurality of resonators are selected having known different values of Q, said resonators being coupled in series, wherein said resonators in series comprise a first resonator, said first resonator being the resonator to first encounter an input signal and having a high $IP_n$ value.

2. The filter of claim 1, wherein said said high IP is greater than approximately 20 dBm.

3. The filter of claim 1, wherein said resonators in series comprise a last resonator, said last resonator being the resonator to last encounter an input signal having a low $IP_n$ value.

4. The filter of claim 3, wherein said low IP is less than approximately 20 dBm.

5. The filter of claim 3, wherein said resonators in series comprise a number of middle resonators, at least one of said middle resonators having a high Q value and a low $IP_n$ value.

6. The filter of claim 5, wherein said high Q is more than approximately 10,000 and said low IP is less than approximately 20 dBm.

7. The filter of claim 1, wherein said filter further comprises superconducting materials.

8. The filter of claim 1, wherein said plurality of resonators include metal materials.

9. The filter of claim 1, wherein said plurality of resonators include dielectric materials.

10. The filter of claim 1, wherein said filter is configured so as to reduce the total intermodulation distortion product of the filter by designing at least one of said plurality of said resonators to have an $IP_n$ higher than the $IP_n$ of the other resonators.

11. The filter of claim 10, wherein a first resonator closest to an input of said filter has an $IP_n$ higher than the $IP_n$ of the other resonators.

12. The filter of claim 11, wherein said filter is a microstrip-line filter and said first resonator is a spiral in, spiral out resonator with longer traces than traces of said other resonators and said first resonator and said first resonator operates in a second mode for improved IP.

13. The filter of claim 1, wherein said filter is included in a transmitter or receiver of a wireless communication mobile station or base-station.

14. The filter of claim 1, wherein the first resonator has a Q value less than approximately 10,000.

15. The filter of claim 1, wherein the first resonator has a Q value greater than approximately 10,000.

16. The filter of claim 1, wherein the filter is selected from the group consisting of a band-pass filter, a high-pass filter, and a low-pass filter.

17. A filter comprising:

a plurality of resonators coupled together, at least two of said plurality of resonators are selected having known different values of intermodulation IP and at least two of said plurality of resonators are selected having known different values of Q, said resonators being coupled in series, wherein said resonators in series comprise a first resonator, said first resonator being the resonator to first encounter an input signal and having a high Q value and a high $IP_n$ value.

18. The filter of claim 17, wherein said high Q is greater than approximately 10,000 and said high IP is greater than approximately 20 dBm.

19. The filter of claim 17, wherein said resonators in series comprise a last resonator, said last resonator being the resonator to last encounter an input signal and having a low Q value and a low $IP_n$ value.

20. The filter of claim 19, wherein said low Q is less than approximately 10,000 and said low IP is less than approximately 20 dBm.

21. The filter of claim 19, wherein said resonators in series comprise a number of middle resonators, at least one of said middle resonators having a high Q value and a low $IP_n$ value.

22. The filter of claim 21, wherein said high Q is greater than approximately 10,000 and said low IP is less than approximately 20 dBm.

23. The filter of claim 17, wherein said filter is included in a transmitter or receiver of a wireless communication mobile station or base-station.

24. The filter of claim 17, wherein the filter is selected from the group consisting of a band-pass filter, a high-pass filter, and a low-pass filter.

25. A method for filtering electronic signals comprising the step of:

increasing a known IP of one or more resonators in said filter that have the most effect on the intermodulation-distortion products of the filter.

26. The method of claim 25, wherein said IP includes $IP_n$.

27. The method of claim 26, wherein a first resonator closest to an input of said filter has increased IP.

28. The method of claim 27, further comprising the step of providing at least two of said resonators with known different values of Q.

29. The method of claim 28, wherein said first resonator has a low Q and a high $IP_n$.

30. The method of claim 29, wherein said low Q is less than approximately 10,000 and said high IP is greater than approximately 20 dBm.

31. The method of claim 25, further comprising the step of analyzing the IMD, Q or insertion loss of each resonator in said filter and determine which resonators have the most effect on the IMD and Q for the particular type of filter and anticipated frequencies in an intended application of the filter.

32. The method of claim 25, wherein said filter is made of superconducting material.

33. The method of claim 25, wherein said one or more resonators include metal materials.

34. The method of claim 25, wherein said one or more resonators include dielectric materials.

35. The method of claim 25, wherein said filter is a multi-resonator filter for use in a wireless communication base-station transceiver.

36. The method of claim 25, further comprising the step of analyzing the IMD of each resonator in said filter and determine which resonators have the most effect on the Q for the particular type of filter and anticipated frequencies in an intended application of the filter.

37. A method for filtering electronic signals comprising:

decreasing a known Q of one or more resonators in said filter that have the least effect on insertion losses of the filter.

38. The method of claim 37, wherein a first resonator closest to an input of said filter has a decreased Q.

39. The method of claim 38, further comprising the step of providing at least two of said resonators with known different values of IP.

40. The method of claim 39, wherein said first resonator has a low Q and a high $IP_n$.

41. The method of claim 39, wherein said low Q is less than approximately 10,000 and said high IP is greater than approximately 20 dBm.

42. The method of claim 37, further comprising the step of:

increasing a known IP of one or more resonators in said filter that have the most effect on the intermodulation-distortion products of the filter.

43. The method of claim 42, further comprising the step of analyzing the IMD, Q or insertion loss of each resonator in said filter and determine which resonators have the most effect on the IMD and Q for the particular type of filter and anticipated frequencies in an intended application of the filter.

44. The method of claim 37, wherein said filter is made of superconducting material.

45. The method of claim 37, wherein said one or more resonators include metal materials.

46. The method of claim 37, wherein said one or more resonators include dielectric materials.

47. The method of claim 37, wherein said filter is a multi-resonator filter for use in a wireless communication base-station transceiver.

48. A filter comprising:

a plurality of resonators coupled together, at least one of the plurality of resonators being a HTS resonator, and at least two of said plurality of resonators having known different values of unloaded Q, at least two of said plurality of resonators have known different intermodulation intercept point values and wherein said resonators are coupled in series and said known different unloaded Q values and intermodulation intercept point values are selected so as to reduce intermodulation distortion.

49. The filter of claim 48 wherein said resonators coupled in series include a first resonator, said first resonator being the resonator to first encounter an input signal and having a high intermodulation intercept point value.

50. The filter of claim 49 wherein said high intermodulation intercept point value is greater than approximately 20 dBm.

51. The filter of claim 49, wherein the first resonator of the plurality of resonators is selected to have a high intermodulation intercept value greater than the intermodulation intercept value of the remainder of the plurality of resonators.

52. The filter of claim 49, wherein the first resonator is a planar disk resonator.

53. The filter of claim 49, wherein the first resonator is made from a dielectric material.

54. The filter of claim 49, wherein the high intermodulation intercept point value is selected so as improve the power-handling capabilities of the filter.

55. The filter of claim 48, wherein the number of poles is $\geqq 4$.

56. The filter of claim 48, wherein a last resonator of the plurality of resonators is selected to have a low unloaded Q value and a low intermodulation intercept point value.

57. The filter of claim 49, wherein the first resonator of the plurality of resonators is selected to have an unloaded Q value lower than the unloaded Q value of the remainder of the plurality of resonators.

58. The filter of claim 49, wherein the first resonator has a high unloaded Q value.

59. The filter of claim 49, wherein the high intermodulation intercept point value is selected so as to prevent out-of-band signals from creating intermodulaton products.

60. The filter of claim 59, wherein the out-of-band signal is a specialized mobile radio (SMR) signal.

61. The filter of claim 59, wherein the out-of-band signal is a cellular/PCS signal.

62. The filter of claim 49, wherein the first resonator has a low unloaded Q value.

63. The filter of claim 62, wherein the first resonator has an unloaded Q value of less than approximately 10,000.

64. The filter of claim 62, wherein the first resonator has an unloaded Q value of greater than approximately 10,000.

65. The filter of claim 48 wherein said filter is configured so as to reduce the magnitude or the number of total intermodulation products of the filter.

66. The filter of claim 48 wherein said a filter is included in transmitter or receiver of a wireless communication mobile station or base-station.

67. The filter of claim 48, wherein said plurality of resonators include metal materials.

68. The filter of claim 48, wherein said plurality of resonators include dielectric materials.

69. The filter of claim 48, wherein said plurality of resonators includes a first resonator, the first resonator being formed from a metal.

70. The filter of claim 48, wherein the order of the intermodulation distortion products is a non-negative real number or a combination of non-negative real numbers.

71. The filter of claim 48, wherein the plurality of resonators are coupled in series.

72. The filter of claim 48, wherein the passband is within the range of 1,800–2,000 MHz.

73. The filter of claim 48, wherein at least some of the plurality of resonators are capacitively coupled together.

74. The filter of claim 48, wherein the order of the intermodulation distortion products is a non-negative real number or a combination of non-negative real numbers.

75. The filter of claim 48, wherein the passband is within the range of 800–900 MHz.

76. The filter of claim 49, wherein the first resonator is a spiral in, spiral out resonator with longer traces than traces of the other resonators, and wherein the first resonator operates in a second or higher mode.

77. A filter according to 48, wherein the filter is selected from the group consisting of a band-pass filter, a high-pass filter, and a low-pass filter.

78. A filter comprising:

a plurality of resonators coupled together, at least one of the plurality of resonators being a HTS resonator, wherein a first resonator of the plurality of resonators is selected to have a high intermodulation intercept point value.

79. The filter of claim 78, wherein the first resonator of the plurality of resonators is selected to have an unloaded Q value lower than the unloaded Q value of the remainder of the plurality of resonators.

80. The filter of claim 78, wherein the first resonator of the plurality of resonators is selected to have a high intermodulation intercept point value greater than the intermodulation intercept point value of the remainder of the plurality of resonators.

81. The filter of claim 78, wherein first resonator has a high intermodulation intercept point value greater than approximately 20 dBm.

82. The filter of claim 78, wherein the order of the intermodulation distortion products is a non-negative real number or a combination of non-negative real numbers.

83. The filter of claim 78, wherein the plurality of resonators are coupled in series.

84. The filter of claim 78, wherein the high intermodulation intercept point value is selected so as to prevent out-of-band signals from creating intermodulaton products.

85. The filter of claim 84, wherein the out-of-band signal is a specialized mobile radio (SMR) signal.

86. The filter of claim 84, wherein the out-of band signal is a cellular/PCS signal.

87. The filter of claim 78, wherein the pass-band is within the range of 800–900 MHz.

88. The filter of claim 78, wherein the pass-band is within the range of 1,800–2,000 MHz.

89. The filter of claim 78, wherein the first resonator is a planar disk resonator.

90. The filter of claim 78, wherein the first resonator is made from a dielectric material.

91. The filter of claim 78, wherein the high intermodulation intercept point value is selected so as improve the power-handling capabilities of the filter.

92. The filter of claim 78, wherein the number of poles is $\geqq 4$.

93. The filter of claim 78, wherein a last resonator of the plurality of resonators is selected to have a low unloaded Q value and a low intermodulation intercept point value.

94. The filter of claim 78, wherein the first resonator is a spiral-in, spiral out resonator with longer traces than traces of the other resonators and wherein the first resonator operates in a second or higher mode.

95. The filter of claim 78, wherein the filter is included in the receiver of a wireless communication mobile station or base-station.

96. The filter of claim 78, wherein at least some of the plurality of resonators are capacitively coupled together.

97. The filter of claim 78, wherein the order of the intermodulation distortion products is a non-negative real number or a combination of non-negative real numbers.

98. The filter of claim 97, where in the pass-band is within the range of 800–900 MHz.

99. A filter according to claim 78, wherein the filter is selected from the group consisting of a band-pass filter, a high-pass filter, and a low-pass filter.

100. The filter of claim 78, wherein the first resonator of the plurality of resonators is selected to have an unloaded Q value that is higher than the unloaded Q value of each of the remaining plurality of resonators.

101. A filter comprising:

a plurality of resonators coupled together, at least one of the plurality of resonators being a HTS resonator, wherein one of the plurality of resonators is selected to have a high intermodulation intercept point value.

102. The filter of claim 101, wherein the selected resonator of the plurality of resonators is selected to have an unloaded Q value higher than the unloaded Q value of the remainder of the plurality of resonators.

103. The filter of claim 101, wherein the selected resonator of the plurality of resonators is selected to have a high intermodulation intercept point value greater than the intermodulation intercept point value of remainder of the plurality of resonators.

104. The filter of claim 101, wherein the selected resonator has a high intermodulation intercept point value greater than approximately 20 dBm.

105. The filter of claim 101, wherein the order of the intermodulation distortion products is a non-negative real number or a combination of non-negative real numbers.

106. The filter of claim 101, wherein the plurality of resonators are coupled in series.

107. The filter of claim 101, wherein the high intermodulation intercept point value is selected so as to prevent out-of-band signals from creating intermodulaton products.

108. The filter of claim 107, wherein the out-of-band signal is a specialized mobile radio (SMR) signal.

109. The filter of claim 107, wherein the out-of-band signal is a cellular/PCS signal.

110. The filter of claim 101, wherein the pass-band is within the range of 1,800–2,000 MHz.

111. The filter of claim 101, wherein the first resonator is a planar disk resonator.

112. The filter of claim 101, wherein the first resonator is made from a dielectric material.

113. The filter of claim 101, wherein the high intermodulation intercept point value is selected so as improve the power-handling capabilities of the filter.

114. The filter of claim 101, wherein the number of poles is $\geqq 4$.

115. The filter of claim 101, wherein a last resonator of the plurality of resonators is selected to have a low unloaded Q value and a low intermodulation intercept point value.

116. The filter of claim 101, wherein the first resonator is a spiral in, spiral out resonator with longer traces than traces of the other resonators, and wherein the first resonator operates in a second or higher mode.

117. The filter of claim 101, wherein the filter is included in the receiver of a wireless communication mobile station or base-station.

118. The filter of claim 101, wherein at least some of the plurality of resonators are capacitively coupled together.

119. The filter of claim 101, wherein the order of the intermodulation distortion products is a non-negative real number or a combination of non-negative real numbers.

120. A filter according to claim 101, wherein the filter is selected from the group consisting of a band-pass filter, a high-pass filter, and a low-pass filter.

121. The filter of claim 101, wherein the selected resonator of the plurality of resonators is selected to have an unloaded Q value lower than the unloaded Q value of the remainder of the plurality of resonators.

122. A method for reducing intermodulation distortion in a filter caused by out-of-band signals, comprising the steps of:

selecting a plurality of resonators such that at least two of the resonators have different intermodulation intercept points and at least one of the plurality of resonators is a HTS resonator, and coupling the plurality of resonators.

123. The method of claim 122, the plurality of resonators including a first resonator, said first resonator being the resonator to first encounter an input signal, wherein the first resonator of the plurality of resonators is selected to have a intermodulation intercept point value greater than the intermodulation intercept point value of each of the remaining plurality of resonators.

124. The method of claim 122, the plurality of resonators including a first resonator, said first resonator being the resonator to first encounter an input signal, wherein the first resonator is selected to have a intermodulation intercept point value greater than approximately 20 dBm.

125. The method of claim 124, wherein the first resonator is selected to have an unloaded Q value of less than approximately 10,000.

126. A method according to claim 122, wherein the filter is selected from the group consisting of a band-pass filter, a high-pass filter, and a low-pass filter.

127. The method of claim 124, wherein the first resonator is selected to have an unloaded Q value of more than approximately 10,000.

128. A filter comprising:

a plurality of resonators coupled together, at least one of the plurality of resonators being a HTS resonator, wherein a first resonator of the plurality of resonators is selected to have a high intermodulation intercept point value and the filter is selected from the group consisting of band-pass filters, high-pass filters, and low-pass filters.

129. A filter comprising:

a plurality of resonators coupled together, at least two of the plurality of resonators having known different values of unloaded Q and at least two of the plurality of resonators having known different intermodulation intercept point values, the plurality of resonators being coupled in series, wherein the unloaded Q values and the intermodulation intercept point values are selected so as to reduce intermodulation distortion, and wherein the filter is selected from the group consisting of a band-pass filter, a high-pass filter, and a low-pass filter.

130. A filter comprising:

a plurality of resonators coupled together, at least two of said plurality of resonators are selected having known different values of intermodulation IP and at least two of said plurality of resonators are selected having known different values of Q, said resonators being coupled in series, wherein said resonators in series comprise a first resonator, said first resonator being the resonator to first encounter an input signal and having a high Q value and a high $IP_n$ value.

* * * * *